United States Patent [19]

Schardein et al.

[11] 4,192,722

[45] Mar. 11, 1980

[54] COMPOSITION AND METHOD FOR STANNATE PLATING OF LARGE ALUMINUM PARTS

[75] Inventors: Daniel J. Schardein, Richmond; Charles M. Rogers, Powhatan; Diane N. Vice, Richmond, all of Va.

[73] Assignee: Reynolds Metals Company, Richmond, Va.

[21] Appl. No.: 927,915

[22] Filed: Jul. 25, 1978

[51] Int. Cl.[2] ..... C25D 5/10; C25D 5/44; C23C 3/02

[52] U.S. Cl. ..... 204/38 B; 106/1.25; 204/33

[58] Field of Search ..... 204/33, 54 L, 38 B; 427/436; 106/1.22, 1.25

[56] References Cited

U.S. PATENT DOCUMENTS

| | | | |
|---|---|---|---|
| 1,627,900 | 5/1927 | Hewitson | 204/33 |
| 2,142,564 | 1/1939 | Korpium | 204/33 |
| 3,274,021 | 9/1966 | Jongkind et al. | 427/436 |
| 4,100,038 | 7/1978 | Jongkind | 204/33 |

FOREIGN PATENT DOCUMENTS

| | | | |
|---|---|---|---|
| 735344 | 5/1966 | Canada | 106/1.25 |
| 811131 | 4/1969 | Canada | 204/33 |
| 1496899 | 11/1973 | Fed. Rep. of Germany | 204/33 |
| 1398605 | 6/1964 | France | 204/33 |

OTHER PUBLICATIONS

An Introduction to Sequestrene and Chelating Agents, Dyestuffs & Chemicals Divs., Ciba-Geigy Corp.

S. Wernick, et al., Surface Treatment and Finishing of Aluminum and Its Alloys, 1956, pp. 464–469.

Handbook of Chemistry and Physics, Chemical Rubber Pub Co., 1962, pp. 1476–1489.

Technical Data Sheet P-Sn-80, M&T Chemicals Inc., New York, N.Y.

Tentative Technical Data Sheet, Alstan XP-231, M & T Chemicals, Inc. New York, N.Y.

*Primary Examiner*—T. M. Tufariello

*Attorney, Agent, or Firm*—Glenn, Lyne, Girard, Clark and McDonald

[57] ABSTRACT

A composition and method for deoxidation or "activation" treatment of aluminum according to the stannate process in an alkaline tin solution, for either immersion or electrolytic plating of aluminum with tin, that provides an adherent tin layer and extends the allocable elapsed transfer time, between the activation bath and bronze strike bath, from the 20 seconds of the prior art to up to 2 minutes or more, whereby the stannate method for depositing tin on heavy parts such as aluminum automobile bumpers is commercially practicable for automatic plating of certain aluminum alloys such as alloy 7029.

15 Claims, No Drawings

COMPOSITION AND METHOD FOR STANNATE PLATING OF LARGE ALUMINUM PARTS

BACKGROUND OF THE INVENTION

1. Field of the Invention

This invention relates to both electrolytic and immersion plating of aluminum and particularly relates to the stannate process for plating aluminum with tin.

2. Review of the Prior Art

Aluminum is an electrochemically very active metal and readily combines with any oxygen present to form a compact, continuous coating of $Al_2O_3$. Bare aluminum surfaces consequently do not exist except in an absolute vacuum so that when an aluminum object is looked at or touched, the surface perceived is not aluminum but aluminum oxide. This ever-present aluminum oxide film, 10–150 Angstroms thick, is largely responsible for aluminum's excellent corrosion resistance, protecting the bulk aluminum from the environment with a relatively inert coating that is self-healing if disturbed. However, this oxide coating is also largely responsible for the difficulty in achieving adherent electrodeposits because it prevents intimate interatomic contact between the aluminum and the plated metal.

Any plating process for aluminum must substantially remove the oxide film or otherwise negate its normally negative effect on adhesion. It is true that other factors also may play a role in adhesion, such factors being aluminum's relative position in the electromotive series with respect to the plating bath metal and the respective crystal structures, atomic diameters, and mutual solubilities of the metals, but the removal of the oxide coating is of foremost importance. Pretreatments prior to the oxide removal step, such as degreasing, chemical brightening, etching, and desmuting, all of which are followed by water rinsing, have essentially no influence on adhesion other than the mechanical effect caused by surface roughness. The reason therefor is that the oxide film, even if essentially removed by any of these treatments, immediately reforms upon water rinsing.

The two best electrolytes for removing oxide are those containing the OH ion and the F ion. It is thus no coincidence that historically the best pretreatments for aluminum were based on solutions containing sodium or potassium hydroxide or hydrofluoric acid. Aluminum plating processes began in 1896 and have included U.S. Pat. No. 1,627,900 (the zincate process) in 1927, the phosphoric anodizing process in 1934, the oxalic anodizing process in 1934, the double zincate process in 1939 as disclosed in U.S. Pat. No. 2,142,564, and the stannate process in 1965 which was improved upon according to the disclosure of U.S. Pat. No. 3,274,021.

All of these processes, except anodizing, rely on the removal of the oxide film by chemical dissolution and the protection of the aluminum surface from re-oxidation by a chemically deposited coating of zinc or tin, and then, for tin, by proceeding to an electrolytic strike without rinsing. The anodizing processes rely on building a relatively thick and porous aluminum-oxide coating which anchors or "keys" a subsequent electrodeposit. The non-anodizing processes attempt to achieve a metallurgical bond between the atoms of the substrate and the deposit while the anodizing process relies on mechanical bonding which requires meeting two criteria: a measurably thick oxide coating and a consistently large pore volume.

Prior art electrolytic and immersion baths for the stannate process are typically made up by dissolving stannate values (such as stannate salts, e.g., potassium stannate and sodium stannate), alkali metal hydroxides (such as potassium hydroxide or sodium hydroxide), and polyhydroxy carboxylic acid anion values (such as polyhydroxy monocarboxylic or polycarboxylic acids or salts thereof, e.g., Rochelle salts), in water so that the resulting solution contains from about 0.06 mole/l to saturation (typically about 0.25 mole/l) of the stannate salt, about 0.5 to 12 g/l (equivalent free KOH), typically about 4 g/l, of the alkali metal hydroxide, and from about 0.01 mole/liter to about 0.25 mole/liter (equivalent acid salt) of the acid anion values. The resulting tin content of these baths is about 10 g/l to 70 g/l, preferably about 30–40 g/l.

Other suitable polyhydroxy carboxylic acid anion values besides those mentioned are set forth in U.S. Pat. No. 3,274,021 to J. C. Jongkind, et al, the disclosure of which is hereby incorporated herein by reference. Versenes, including ethylene diamine tetraacetic acid, may also be added to form the basic bath, as taught in Canadian Pat. No. 811,131 to L. P. Gowman, et al, the disclosure of which is also hereby incorporated herein by reference.

The prior art baths may typically be used interchangeably for electrolytic and immersion plating. Electrolytic plating is conventionally carried out at a potential of about 2–6 volts and a current density of about 30 amps per square foot.

Deposition of tin in the stannate process releases free hydroxide. Thus the continued operation of a stannate plating bath tends to develop inreasingly thick tin deposits unless the free hydroxide is neutralized by adding an acid or by incorporating anions of polyhydroxy carboxylic acids. Typically the free KOH is at an operating level of about 5 g/l.

Many uses for plated aluminum are currently developing in the automotive industry which is undergoing rapid changes because of federally mandated requirements for increased fuel economy each model year until 1985 when the fleet average must equal 27.5 miles per gallon. Because substituting aluminum for steel saves 2.25 lbs. for every pound of aluminum used, the industry is taking every feasible means to effect a weight reduction in its entire fleet and is particularly attempting to expand its use of high strength-to-weight ratio materials, such as high-strength bright-anodized aluminum bumpers and bright chrome-plated aluminum bumpers.

The processing sequence used for electrolytic stannate pre-plate conditioning of aluminum automobile bumpers is as follows:

Buff, alkaline degrees, mild alkaline etch, desmut, tin activate, transfer without rinse, bronze-strike with live entry, water rinse, acid rinse, and plate. The transfer operation between the tin activation solution and the bronze strike solution is carried out without an intermediate rinse in order to prevent re-oxidation during the rinse. This transfer operation proceeds without difficulty when small objects are being prepared for plating because they can be quickly lifted, moved, and lowered into the strike bath. However, when large and cumbersome objects such as aluminum automobile bumpers are being handled, the mechanical operations that are required cause the transfer time to be unduly extended, thus creating a problem that has arisen specifically in the chrome plating of aluminum bumpers which are made by successively plating with tin, bronze, copper, duplex nickel and then chrome.

Stated generally, the problem arises because when an article to be plated is withdrawn from a prior art alkaline bath, tin tends to come out of solution in the bath film which remains on the part. Within about fifteen seconds from the time that the part is removed from the bath, the surface of the part beings to be coated with a loose, flaky layer of tin which renders the part unsuitable for many commercial purposes and specifically for subsequent plating operations.

With respect to aluminum automobile bumpers, the transfer time from one tank to another during automatic plating operations can take as long as 45 seconds, causing the upper areas of the plated work to develop non-adherent dark deposits of tin during transfer, resulting in blistered deposits of bronze. This problem was slightly alleviated in prior art baths where the free KOH level was noted to have been slightly raised from 5 g/l to 6 g/l, and the transfer time was extended to slightly less than 30 seconds for most aluminum alloys, including relatively pure aluminum such as 1100, magnesium-containing alloys such as 5052 and 6061, copper-bearing alloys such as 2024, and zinc-containing alloys such as 7075 and 7005. For some of these alloys, the improved prior art process can tolerate transfer times of up to 45 seconds.

However, some alloys, including the important zinc-containing alloys 7029 and 7129, continue to manifest this problem for transfer times above 15–20 seconds. 7029 alloy has the following commercial composition: 0.10% Si, 0.12% Fe, 0.03% Mn, and 0.03% Ti as maximum amounts; 0.5–0.9% Cu, 1.3–2.0% Mg, and 4.2–5.2% Zn; 0.03% maximum for each other constituent; and 0.10% maximum for a total of all other constituents. 7029 alloy is commercially available in a thickness range of 0.100–0.250 inch, average Brinnel hardness ($T_5$) of 127 UTS ($T_5$) of 62 ksi, and YS ($T_5$) of 55 ksi. 7129 alloy is basically the same as 7029 alloy except that it has greater impurity level tolerances. The composition limits for 7129 alloy are: 0.15% Si, 0.30% Fe, 0.10% Mn, 0.05% Ti, 0.10% Cr, 0.03% Ga, and 0.05% Va as maximum amounts; 0.50–0.9% Cu, 1.3–2.0% Mg and 4.2–5.2% Zn; 0.03% maximum for each other constituent; and 0.10% maximum for a total of all other constituents. These alloys are presently favored alloys for manufacturing aluminum automobile bumpers.

A practical process and composition for activation treatment and tin plating of large aluminum objects, particularly when made of alloys 7029 and 7129 is accordingly needed for automatic plating operations.

SUMMARY OF THE INVENTION

It is an object of this invention to provide a composition for immersion or electrochemical plating of tin onto aluminum alloys, including the 7029 and 7129 alloys, that will provide transfer times greater than 45 seconds.

It is also an object of this invention to provide a process for immersion or electrochemical plating of tin onto aluminum alloys, including the 7029 and 7129 alloys, that will allow transfer times greater than 45 seconds without reduction of adherency.

In accordance with these objectives, a composition and method are herein provided for improving the stannate process for electrolytic and immersion plating of aluminum alloys with tin, particularly for the 7029 and 7129 alloys, which allows at least a one-minute transfer time without adherency problems and a transfer time as long as two minutes or more under suitable conditions.

This improved process comprises the selective addition of one to three additives to the basic tin-plating stannate solutions of the prior art. These three additives are: (A) hydroxyl values, such as potassium hydroxide, or sodium hydroxide, which when added increase the alkalinity to a free equivalent KOH level of about 18 g/l, typically extend the allowable transfer time for the 7029 and 7129 alloys by about 30 seconds; (B) sulfate values, such as $Na_2SO_4$, which when added in suitable amounts (to increase the solubility of the tin ion) also typically extend the allowable transfer time for the 7029 and 7129 alloys by about 30 seconds; and (C) a chelating agent, which when added in suitable amounts (to form complex compounds with the tin) further typically extend the allowable transfer time for the 7029 and 7129 alloys by about 30 seconds. By making these three additions in combination, it has surprisingly been discovered that the allowable transfer time for the 7029 and 7129 alloys can be extended to about two minutes or more. The improved plating solution has also been found to be applicable in extending the allowable transfer time for the high purity aluminum alloys, such as 1100 alloy.

For preparing the basic plating solution of this invention, the preferred stannate salt is potassium stannate, and the preferred polyhydroxy carboxylic acid anion values are Rocelle salts (sodium and potassium tartrate).

The preferred alkali metal hydroxide additive is potassium hydroxide. The preferred chelating agent is tri-sodium hydroxyethylethylene-diaminetriacetate at up to about 0.06 mole per liter of the activiation solution. Other suitable chelating agents are ehtylene diamine tetraacetic acid, hydroxyethylethylenediaminetriacetic acid, diethylenetriaminepentaacetic acid, pentasodium diethylenetriaminepentaacetate, ethylenediamine di (o-hydroxyphenyl acetic acid), and ethyleneglycol bis (aminoethylether) titraacetic acid, each being present at up to about 0.06 mole per liter of the solution.

DESCRIPTION OF THE PREFERRED EMBODIMENTS

The preferred approach for manufacturing chromium-plated automobile bumpers of aluminum alloy such as 7029 alloy, is as follows: buff, alkaline degrease, mild alkaline etch, desmut, tin activate, transfer without rinse, bronze strike, water rinse, acid rinse, copper, duplex nickel and chromium plate. The tin activation step is the subject of this invention, and extending the allowable transfer time for the 7029 and 7129 alloys without the rinse step is its goal.

EXAMPLE 1

A basic tin-plating solution was made up as follows, on a one-liter basis:

0.25 mole potassium stannate;

0.25 mole sodium and potassium tartrate (Rochelle salt); and 0.11 mole potassium hydroxide.

This basic solution contains about six g/l free equivalent KOH and approximates the improved prior art solution which has been effective for 7029 and 7129 of aluminum alloys by extending allowable transfer times to as much as 45 seconds. Because the immersion process is slightly more sensitive to transfer time between the tin-plating and bronze strike baths than the electrolytic process, it was used for most plating tests. These tests were conducted by immersing cleaned 7029 alloy samples at 70°-75° F. for 45 seconds in the basic tin-plating solution or in this solution admixed with one or more of the three additives and then holding the samples in air during transfer from the tin-plating bath to the bronze-plating bath. The bronze-plated samples were then judged for adhesion by rating them as poor if there were blisters, as fair if there were slight edge failures, and as good if there were no failures in the conventional tape test. Good adhesion was judged to be the criterion for the maximum transfer time that would be allowable.

The following table lists the maximum transfer times in seconds after immersion in the basic tin-plating solution and in this solution containing various levels of the three additives.

TABLE I

| | Grams/Liter Sodium Sulfate | | | | | | | |
|---|---|---|---|---|---|---|---|---|
| | 0 | | 50 | | 100 | | 150 | |
| g/l KOH | ml/l 0 | chel 20 | ml/l 0 | chel 20 | ml/l 0 | chel 20 | ml/l 0 | chel 20 |
| 6 | 25 | 30 | 35 | 50 | 70 | 70 | 45 | 35 |
| 12 | 30 | 35 | 45 | 80 | 70 | 75 | 90 | 30 |
| 18 | 35 | 45 | 60 | 80 | 70 | 105 | 105 | 45 |
| 24 | 15 | 90 | 100 | 100 | 100 | 105 | 135 | 45 |
| 30 | 90 | 90 | 100 | 145 | 110 | 105 | 150 | 60 |
| 36 | 90 | 90 | 100 | 130 | 150 | 120 | 10 | 15 |

The inner outlined area brackets the compositions that provide a minimum of 45 seconds transfer time. Compositions having a free KOH content above 24 g/l were excluded, however, because of excessive etching and a general lessening of adhesion. At 150 g/l sodium sulfate, the solution is nearly saturated so that no higher concentrations were used. The chelating agent, identified as "chel", was trisodium hydroxyethyl ethylene diamine which is supplied by Geigy Industrial Chemicals as a 41% solution under the trademark Chel Dm 41.

Thus the bracketed area represents what is believed to be the optimum range for both transfer time and degree of adhesion. A preferred composition that is normally used is more or less in the center of this area; i.e., 18 g/l free KOH, 100 g/l sodium sulfate, and 20 ml/l Chel DM 41.

Among other aluminum alloys which were tested with the methods and compositions of this invention, 7146 sheets, 7021 sheets, 7029 sheets, and 7029 extrusions were successfully tested at the additive levels shown within the bracketed area of Table I.

EXAMPLE 2

Similar studies were made by combining the three additives with prior art commercial solutions for electrolytic deposition of tin (Alstan 80) and for immersion deposition of tin (Alstan 88), instead of the basic tin-plating solution used in Example I. Results for Alstan 88 are shown in Table II and are evidently similar to those in Table I.

TABLE II

| | Grams/Liter Sodium Sulfate | | | | | | | |
|---|---|---|---|---|---|---|---|---|
| | 0 | | 50 | | 100 | | 150 | |
| g/l KOH | ml/l 0 | chel 20 | ml/l 0 | chel 20 | ml/l 0 | chel 20 | ml/l 0 | chel 20 |
| 6 | 10 | — | 25 | — | 45 | — | 45 | — |
| 12 | 15 | — | 30 | — | 45 | — | 45 | — |
| 18 | 20 | 45 | 45 | 90 | 50 | 110 | 45 | 60 |
| 24 | 25 | — | 45 | — | 50 | — | 50 | — |
| 30 | 35 | — | 50 | — | 45 | — | 45 | — |

TABLE II-continued

| | Grams/Liter Sodium Sulfate | | | | | | | |
|---|---|---|---|---|---|---|---|---|
| | 0 | | 50 | | 100 | | 150 | |
| g/l KOH | ml/l 0 | chel 20 | ml/l 0 | chel 20 | ml/l 0 | chel 20 | ml/l 0 | chel 20 |
| 36 | 45 | — | — | — | — | — | — | — |

Alstan 80 and Alstan 88 are trademarks of the M&T Chemical Company, New York, N.Y. The KOH levels above 24 g/l resulted in a lessened degree of adhesion as evidenced by a dark smut developing over the entire surface.

Additional tests were done on the Alstan 88 solution by using constant 45-second transfer time and rating the resulting adhesion against the level of free KOH and the concentration of sodium sulfate. Table III shows these results in terms of poor, fair, and good adhesion.

TABLE III

| g/l | Free KOH - g/l | | | | |
|---|---|---|---|---|---|
| $Na_2SO_4$ | 6 | 12 | 18 | 24 | 30 |
| 0 | P | P | P | P | F |
| 50 | P | P | G | G | G |
| 100 | G | G | G | G | G |
| 150 | G | G | G | G | G |
| 200 | G | G | G | P | P |

A level of 18 g/l free KOH and 100 g/l $Na_2SO_4$ is about in the center of the good adhesion area. The level of 30 g/l free KOH began to show a general sample darkening identical to that found for additive tests with the basic tin-plating solution.

Because it will be readily apparent to those skilled in the art that innumerable variations, modifications, applications, and extensions of the examples and principles hereinbefore set forth can be made without departing from the spirit and scope of the invention, what is herein defined as such scope and is desired to be protected should be measured, and the invention should be limited, only by the following claims.

What is claimed is:

1. An aqueous alkaline stannate solution, suitable for both immersion and electrolytic plating of aluminum alloys with tin, particularly as an activation step prior to subsequently plating said alloys with other metals such as bronze, which for activating the 7029 and 7129 aluminum alloys provides an allowable transfer time between the activation bath and the subsequent strike bath of at least 45 seconds, said solution comprising:

A. stannate values selected from the group consisting of sodium stannate, potassium stannate, and mixtures thereof;

B. polyhydroxy carboxylic acid anion values;

C. a hydroxyl compound selected from the group consisting of sodium hydroxide, potassium hydroxide, and mixtures thereof, at free equivalent KOH levels of about 24 grams per liter of said solution.

2. The activation solution of claim 1 wherein a chelating agent is additionally present.

3. The activation solution of claim 2 wherein said chelating agent is trisodium hydroxyethyl ethylene diamine.

4. The activation solution of claim 3 wherein said activation solution contains up to about 20 milliliters of a 41% aqueous solution of said trisodium hydroxyethyl ethylene diamine per liter of said activation solution.

5. The activation solution of claim 4 wherein said solution additionally comprises sodium sulfate at more than 50 grams per liter up to about 200 grams per liter of said solution.

6. An aqueous alkaline stannate solution, suitable for both immersion and electrolytic plating of aluminum alloys with tin, particularly as an activation step prior to subsequently plating said alloys with other metals such as bronze, which for activating the 7029 and 7129 aluminum alloys provides an allowable transfer time between the activation bath and the subsequent strike bath of at least 45 seconds, said solution comprising:

A. stannate values selected from the group consisting of sodium stannate, potassium stannate, and mixtures thereof;

B. polyhydroxy carboxylic acid anion values;

C. a hydroxyl compound selected from the group consisting of sodium hydroxide, potassium hydroxide, and mixtures thereof, at free KOH levels of from about 6 to about 24 grams per liter of said solution; and D. sodium sulfate at more than 50 grams per liter and up to about 200 grams per liter of said activation solution.

7. The activation solution of claim 6 wherein a chelating agent is additionally present.

8. The activation solution of claim 7 wherein said chelating agent is trisodium hydroxyethyl ethylene diamine triacetate.

9. The activation solution of claim 8 wherein said activation solution contains up to about 20 milliliters of a 41% aqueous solution of said trisodium hydroxyethyl ethylene diamine triacetate per liter of said activation solution.

10. An aqueous alkaline stannate solution, suitable for both immersion and electrolytic plating of aluminum alloys with tin, particularly as an activation step prior to subsequently plating said alloys with other metals such as bronze, which for activating the 7029 and 7129 aluminum alloys provides an allowable transfer time between the activation bath and the subsequent strike bath of at least 45 seconds, said solution comprising:

A. stannate values selected from the group consisting of sodium stannate, potassium stannate, and mixtures thereof;

B. polyhydroxy carboxylic acid anion values;

C. a hydroxyl compound selected from the group consisting of sodium hydroxide, potassium hydroxide, and mixtures thereof, at free KOH levels of about 12 g/l to about 24 grams per liter of said solution; and D. a chelating agent selected from the group consisting of ethylene diamine tetraacetic acid, N-N-bis(-hydroxyethyl) glycine, and trisodium hydroxyethyl ethylenediamine at up to about 0.06 moles/-liter of said solution.

11. The activation solution of claim 10 wherein said solution also comprises from about 50 to about 200 grams of sodium sulfate per liter of said solution.

12. The activation solution of claim 11 wherein said solution comprises about 18 grams per liter of free KOH, about 100 grams per liter of sodium sulfate, and about 0.03–0.06 mole of said chelating agent.

13. An aqueous alkaline stannate solution, suitable for both immersion and electrolytic plating of aluminum alloys with tin, particularly as an activation step prior to subsequently plating said alloys with other metals such as bronze, which for activating the 7029 and 7129 aluminum alloys provides an allowable transfer time between the activation bath and the subsequent strike bath of at least 45 seconds, said solution comprising:

A. stannate values selected from the group consisting of sodium stannate, potassium stannate, and mixtures thereof;

B. polyhydroxy carboxylic acid anion values;

C. a hydroxyl compound selected from the group consisting of sodium hydroxide, potassium hydroxide, and mixtures thereof, at free KOH levels of about 18 to about 24 grams per liter of said solution; and D. a chelating agent selected from the group consisting of ethylene diamine tetraacetic acid, hydroxyethylethylenediaminetriacetic acid, trisodium hydroxyethylethylenediaminetriaciatate, diethylenetriaminepentaacetic acid, pentasodium diethylenetriaminepentaacetate, ethylenediamine di(o-hydroxyphenyl acetic acid), and ethyleneglycol bis(aminoethylether) tetraacetic acid, said chelating agent being present at about 0.06 mole per liter of said solution.

14. The activation solution of claims 1, 6, 10 or 13 wherein about 0.25 mole of said stannate values and about 0.25 mole of said acid anion values are present per liter of said solution.

15. The activation solution of claims 1, 6, 10 or 13 wherein said acid anion values are selected from the group consisting of sodium tartarate, potassium tartarate, and mixtures thereof.

* * * * *